United States Patent [19]

Orford

[11] 4,131,460

[45] Dec. 26, 1978

[54] METHOD OF PRODUCING A SINTERED COMPOSITION

[75] Inventor: Raymond L. Orford, Solihull, England

[73] Assignee: Lucas Industries Limited, Birmingham, England

[21] Appl. No.: 778,605

[22] Filed: Mar. 17, 1977

[30] Foreign Application Priority Data

Mar. 20, 1976 [GB] United Kingdom ..... 11321/76

[51] Int. Cl.[2] ..... B22F 1/00; H01R 39/20

[52] U.S. Cl. ..... 75/204; 29/597; 75/208 R; 310/249; 310/252; 310/251; 252/504

[58] Field of Search ..... 310/249, 252, 251; 75/208 R, 204; 29/597; 252/504

[56] References Cited

U.S. PATENT DOCUMENTS

| | | | |
|---|---|---|---|
| 2,353,047 | 7/1944 | Lannert | 310/251 |
| 2,823,419 | 2/1958 | Winters et al. | 75/208 R |
| 3,214,651 | 10/1965 | Van Dyck et al. | 75/208 R |
| 3,358,166 | 12/1967 | Nolan | 310/252 |
| 3,392,295 | 7/1968 | Sebok | 310/251 |
| 3,489,554 | 1/1970 | Waldo | 75/208 R |
| 3,601,645 | 8/1971 | Whiteheart | 310/251 |

*Primary Examiner*—Brooks H. Hunt

[57] ABSTRACT

A method of producing a sintered composition used as a brush for a dynamo electric machine, includes the steps of compacting a powder from which the brush is to be made around one end of an electrical lead with the remainder of the lead projecting from the compacted powder, and then heating in a non-reducing atmosphere the assembly of the lead and the compacted powder to sinter the powder into the required brush and physically electrically connect the lead to the brush.

10 Claims, 1 Drawing Figure

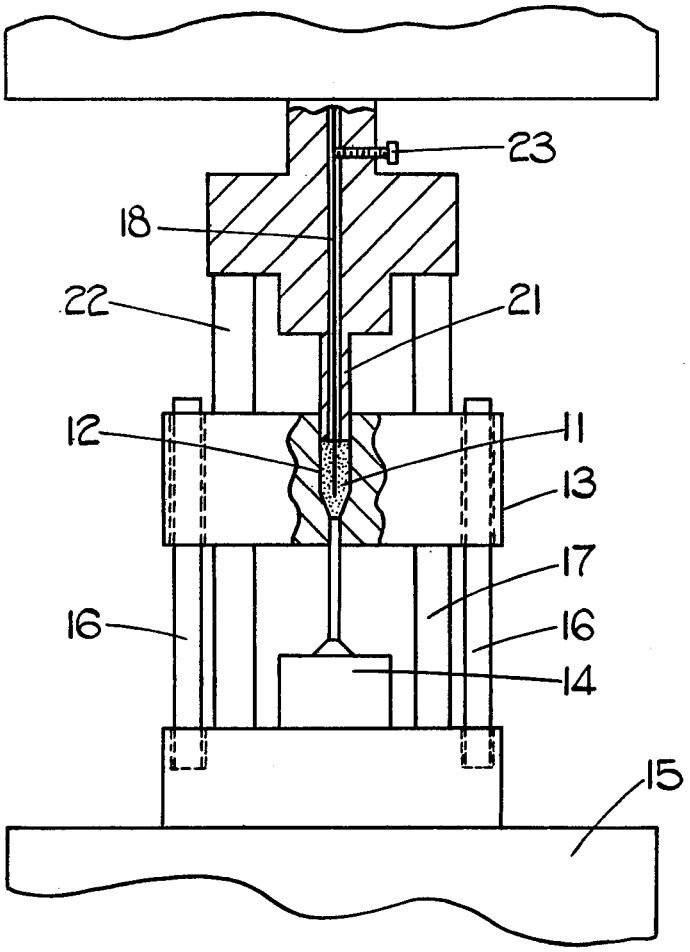
23
18
22
21
12
11
13
17
16
16
14
15

METHOD OF PRODUCING A SINTERED COMPOSITION

This invention relates to a method of producing a sintered composition for use as a brush for a dynamo electric machine.

The invention resides in a method of producing a brush for a dynamo electric machine, including the steps of compacting a powder from which the brush is to be made around one end of an electrical lead with the remainder of the lead projecting from the compacted powder, and then heating in a non-reducing atmosphere the assembly of the lead and the compacted powder to sinter the powder into the required brush and physically electrically connect the lead to the brush.

Preferably, the lead is formed of copper, and conveniently the copper contains between 0.02 and 0.04% by weight of oxygen.

Preferably, said atmosphere is also non-oxidising and conveniently is a nitrogen or argon atmosphere.

Preferably, said powder is a mixture including silicon carbide, copper and carbon.

Preferably, the mixture contains between 1 and 8% by weight of carbon and between 0.85–5.1% by weight of silicon carbide.

Conveniently, compaction is effected at an applied load of between 10 and 35 tons F/in$^2$, and preferably at 19 tons F/in$^2$.

Conveniently, said heating step is effected at a temperature between 600° and 880° C. and preferably at 800° C.

The accompanying drawing is a diagrammatic illustration of apparatus for performing one stage of a method according to one example of the invention.

Referring to the drawing, in the example shown it was required to produce a brush for a dynamo electric machine from a powder mixture 11 having the following composition by weight:

| | |
|---|---|
| 79% | Copper |
| 12.75% | Lead |
| 2.55% | Tin |
| 4.0% | Graphite, and |
| 1.7% | Silicon carbide (less than 25 micron average particle size) |

The mixture also contained 0.59 parts by weight of a zinc stearate lubricant per 100 parts by weight of the above composition.

The mixture 11 was produced by introducing the required proportions of the starting materials into a Turbula mixer, in which the components were then mixed for 100 minutes. The resultant powder was then introduced into a die cavity 12 defined within the die part 13 of the press assembly shown in the drawing, the lower end of the die cavity 12 being closed by a punch 14 rigidly supported on the base 15 of the press. The die part 13 was slidably mounted above the base 15 on pillars 16, but at this stage was held in position relative to the base by a first spacer 17.

When the die cavity was filled with the mixture 11, an electrical lead 18 formed of tough pitch, high conductivity copper (containing between 0.02% and 0.04% by weight of oxygen) and required for the finished brush was inserted through a bore in a further punch assembly 21, whereafter the assembly 21 together with a second spacer 22 was positioned on the die part 13 to close the upper end of the die cavity 12. The arrangement was such that respective projecting portions of the punch 14 and assembly 21 then engaged the mixture 11, while one end of the lead 18 extended into the mixture, the lead being held in position throughout the processing by a retaining screw 23. In this position the face 24 of the further punch assembly 21 was out of contact with the spacer 22. With the press thus assembled, the powder mixture 11 was compressed around the lead 18 by applying a load of between 10 and 35 tons F/in$^2$, preferably 19 tons F/in$^2$, to the base 15 to thereby raise the components 13 to 17 inclusive, causing the punch assembly 21 to enter the cavity 12 until the face 24 of the assembly 21 touched the second spacer 22. The pressure was then released and, after loosening the screw 23, the assembly 21 was removed so as to leave the lead 18 retained by the compacted powder 11. The spacer 17 was subsequently replaced with smaller, third spacer (not shown) whereby the die part 13 moved towards the base 15 and the punch 14 entered the die cavity 12 to eject the assembly of the lead 18 and the compacted powder 11.

The compacted powder 11 with the lead 18 retained thereby was then loaded in a tube furnace where the assembly was sintered in a non-reducing, and preferably non-oxidising, atmosphere such as nitrogen or argon. Sintering was effected by heating the assembly at a temperature of between 600° and 800° C., preferably 800° C., for twenty minutes, although before the required sintering temperature was attained the temperature in the furnace was held at 450° C. for 15 minutes to dewax the assembly. On cooling to room temperature, it was found that the sintered assembly was ready for use as a brush for a dynamo electric machine, the non-reducing atmosphere used for the sintering process having substantially prevented oxidation or any embrittlement of the tough pitch, high conductivity copper of the lead 18.

The brush produced according to the above example was intended for use with a commutator of the kind in which the insulating material between adjacent conductive segments extended flush with the brush-engaging surfaces of the segments. It was therefore necessary that the brush was able to cope with the variation in material at the brush-engaging surface of the commutator while at the same time exhibiting a low wear rate of the brush together with a low rate of commutator wear. When the brush of the above example was tested with such a commutator, it was found that the brush operated satisfactorily and both the commutator and the brush exhibited a low wear rate. Similar results were obtained when brushes were produced from powder mixtures containing different amounts of the above starting materials provided the amount of silicon carbide (less than 25 micron average particle size) present was between 0.85 and 5.1% by weight and the amount of carbon present was between 1 and 8% by weight.

I claim:

1. A method of producing a brush for a dynamo electric machine, including the steps of compacting a powder from which the brush is to be made comprising a mixture of silicon carbide, copper and carbon around one end of an electrical lead with the remainder of the lead projecting from the compacted powder, and then heating in a non-reducing atmosphere the assembly of the lead and the compacted powder to sinter the powder into the required brush and physically electrically connect the lead to the brush.

2. A method as claimed in claim 1, wherein the lead is formed of copper.

3. A method as claimed in claim 2, wherein the copper contains 0.02–0.04% by weight of oxygen.

4. A method as claimed in claim 1, wherein said atmosphere is non-oxidising.

5. A method as claimed in claim 1, wherein said atmosphere is a nitrogen or argon atmosphere.

6. A method as claimed in claim 1, wherein the mixture contains between 1–8% by weight of carbon and between 0.85–5.1% by weight of silicon carbide.

7. A method as claimed in claim 1, wherein compaction is effected at an applied load of between 10 and 35 tons $F/in^2$.

8. A method as claimed in claim 1, wherein compaction is effected at an applied load of 19 tons $F/in^2$.

9. A method as claimed in claim 1, wherein said heating step is effected at a temperature in the range 600°–880° C.

10. A method as claimed in claim 1, wherein said heating step is effected at a temperature of 800° C.

* * * * *